US006405006B1

(12) United States Patent
Tabuchi

(10) Patent No.: US 6,405,006 B1
(45) Date of Patent: Jun. 11, 2002

(54) IMAGE FORMING APPARATUS AND PHOTOCONDUCTIVE BELT MODULE HAVING A NON-CONTACT PROXIMITY CHARGING DEVICE

(75) Inventor: Takeshi Tabuchi, Kawaguchi (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/689,796

(22) Filed: Oct. 13, 2000

(30) Foreign Application Priority Data

Oct. 15, 1999 (JP) ..... 11-293626

(51) Int. Cl.[7] ..... G03G 15/02
(52) U.S. Cl. ..... 399/162; 399/176
(58) Field of Search ..... 399/162, 168, 399/174–176

(56) References Cited

U.S. PATENT DOCUMENTS

| | | | | |
|---|---|---|---|---|
| 3,935,517 A | | 1/1976 | O'Brien | |
| 4,035,750 A | * | 7/1977 | Staudenmayer et al. | 399/162 X |
| 5,146,280 A | * | 9/1992 | Kisu | 399/176 |
| 5,557,373 A | | 9/1996 | Miyashita et al. | |
| 5,572,293 A | | 11/1996 | Kikuchi et al. | |
| 5,585,896 A | | 12/1996 | Yamazaki et al. | |
| 5,649,265 A | | 7/1997 | Tabuchi | |
| 5,715,499 A | | 2/1998 | Yamazaki et al. | |
| 5,792,533 A | | 8/1998 | Kurokawa et al. | |

FOREIGN PATENT DOCUMENTS

| | | |
|---|---|---|
| EP | 0 496 399 | 7/1992 |
| EP | 0 629 928 | 12/1994 |
| JP | 4-157484 | 5/1992 |
| JP | 5-45998 | 2/1993 |
| JP | 5-173396 | 7/1993 |
| JP | 6-67492 | 3/1994 |
| JP | 9-146386 | 6/1997 |
| JP | 9-171282 | 6/1997 |
| JP | 2910304 | 4/1999 |

OTHER PUBLICATIONS

K. J. Buck, Xerox Disclosure Journal, vol. 5, No. 3, p. 319, "Biased Web Seam", May/Jun. 1980.
European Search Report.

* cited by examiner

*Primary Examiner*—William J. Royer
(74) *Attorney, Agent, or Firm*—Oblon, Spivak, McClelland, Maier & Neustadt, P. C.

(57) ABSTRACT

An image forming apparatus and a photoconductive belt module including an endless belt configured to be electrically charged, a plurality of rollers that span the endless belt around the rollers and rotatively transport the endless belt, and a charging device disposed opposite one of the plurality of rollers and apart from the surface of the endless belt at a predetermined distance and configured to charges a surface of the endless belt electrically.

17 Claims, 9 Drawing Sheets

IMAGE FORMING APPARATUS AND PHOTOCONDUCTIVE BELT MODULE HAVING A NON-CONTACT PROXIMITY CHARGING DEVICE

CROSS REFERENCE TO RELATED APPLICATIONS

This document is based on Japanese patent application No. 11-293626 filed in the Japanese Patent Office on Oct. 15, 1999, the entire contents of which are incorporated herein by reference.

BACKGROUND OF THE INVENTION

1. Field of the Invention

The present invention relates to an image forming apparatus and photoconductive belt module having a non-contact proximity charging device. More particularly, the present invention relates to an image forming apparatus and photoconductive belt module having an endless photoconductive belt and a non-contact proximity charging device disposed in close proximity to the endless photoconductive belt.

2. Discussion of the Background

An image forming apparatus having a photoconductive member, such as a laser printer, a photocopier, a facsimile machine or the like generally provided with a charging device for electrically charging the photoconductive member. As an example of charging devices, a contact charging device, such as a contact charging roller, is used. The contact charging device sometimes has a drawback that the device is vulnerable to be soiled by residual toner particles and other residual particles remained on a photoconductive member. The contact charging device also has another drawback that the device sometimes creates a vestige thereof on the photoconductive member while the contact charging device contacts the photoconductive member for a certain period.

In recent years, to improve or solve the above-stated drawbacks, as another type charging device, a non-contact proximity charging device has been suggested and is becoming a focus of attention and going into actual use. The non-contact proximity charging device is disposed in close proximity to the photoconductive member, and therefore is relatively resistant to be soiled, and hardly creates a vestige thereof on the photoconductive member. Lately, such a non-contact proximity charging device is being introduced into full color laser printers and photocopiers.

Meanwhile, full color image forming apparatuses, such as color laser printers and photocopiers may be classified into various types. One type is referred as an intermediate image transfer type, which is provided with a single photoconductive member and an intermediate transfer member. Another type is referred as a tandem type, which is provided with plural, such as three or four, photoconductive members aligned in tandem. Generally, the intermediate image transfer type color image forming apparatus is advantageous for downsizing of the apparatus, and the tandem type color image forming apparatus has an advantage in productivity of forming images.

As photoconductive member used in an intermediate image transfer type image forming apparatus, either one of a photoconductive drum and a photoconductive belt is frequently utilized depending upon design principles thereof, such as a structure of a developing device, a total layout plan of the apparatus or the like. The photoconductive belt is further categorized into a seamless endless photoconductive belt has advantage over a seamless photoconductive belt in costs, and therefore image forming apparatus provided with a seamed endless photoconductive belt are increasing.

When a distance between a photoconductive member and a non-contact proximity charging device is uneven, for example, an unevenness in a longitudinal direction of the charging device, unevenness of electrical charge on the photoconductive member is likely to be generated. Meanwhile, an endless photoconductive belt is liable to flutter; accordingly difficulty has been experienced in maintaining a preferable predetermined distance between the non-contact charging device and a photoconductive belt as compared with a rigid photoconductive drum.

Further, when a seamed endless photoconductive belt is used together with a non-contact proximity charging device, the seam and the proximity thereof are more liable to generate the above-described unevenness of electrical charge because of a step of the seam and thickness unevenness at the seam and the vicinity thereof.

Furthermore, such a step and thickness unevenness at the seam are sometimes liable even to make a contact with the charging device because of vibration of the photoconductive belt caused by the step and thickness unevenness and other reasons. Such a contact causes a short circuit of charging circuitry of the charging deice, a power supply thereof, the photoconductive belt, and others. Such short circuit current is generally very large compared to an ordinary gaseous discharge current between the charging device and the photoconductive belt. Consequently, such large current sometimes damages the charging device and the photoconductive belt.

Further, the short circuit often causes a sharp pulse current, which acts as high frequently spike noises upon a control circuit of the image forming apparatus. Consequently, such spike noises sometimes cause a malfunction of the control circuit of the image forming apparatus.

SUMMARY OF THE INVENTION

The present invention has been made in view of the above-discussed and other problems and to address the above-discussed and other problems associated with the background apparatus. Accordingly, an object of the present invention is to provide an image forming apparatus and photoconductive belt module having a non-contact proximity charging device that can improve charge unevenness of an endless photoconductive belt in a stable manner.

Another object of the present invention is to provide an image forming apparatus and photoconductive belt module having a non-contact proximity charging device that can decrease short circuits of a charging circuitry.

These and other objects are achieved according to the present invention by providing a novel image forming apparatus and photoconductive belt module including an endless belt to be electrically charged, a plurality of rollers that span the endless belt around the rollers and rotatively transport the endless belt, and a charging device that electrically charges a surface of the endless belt being disposed opposing one of the plurality of rollers and apart from the surface of the endless belt at a predetermined small distance.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
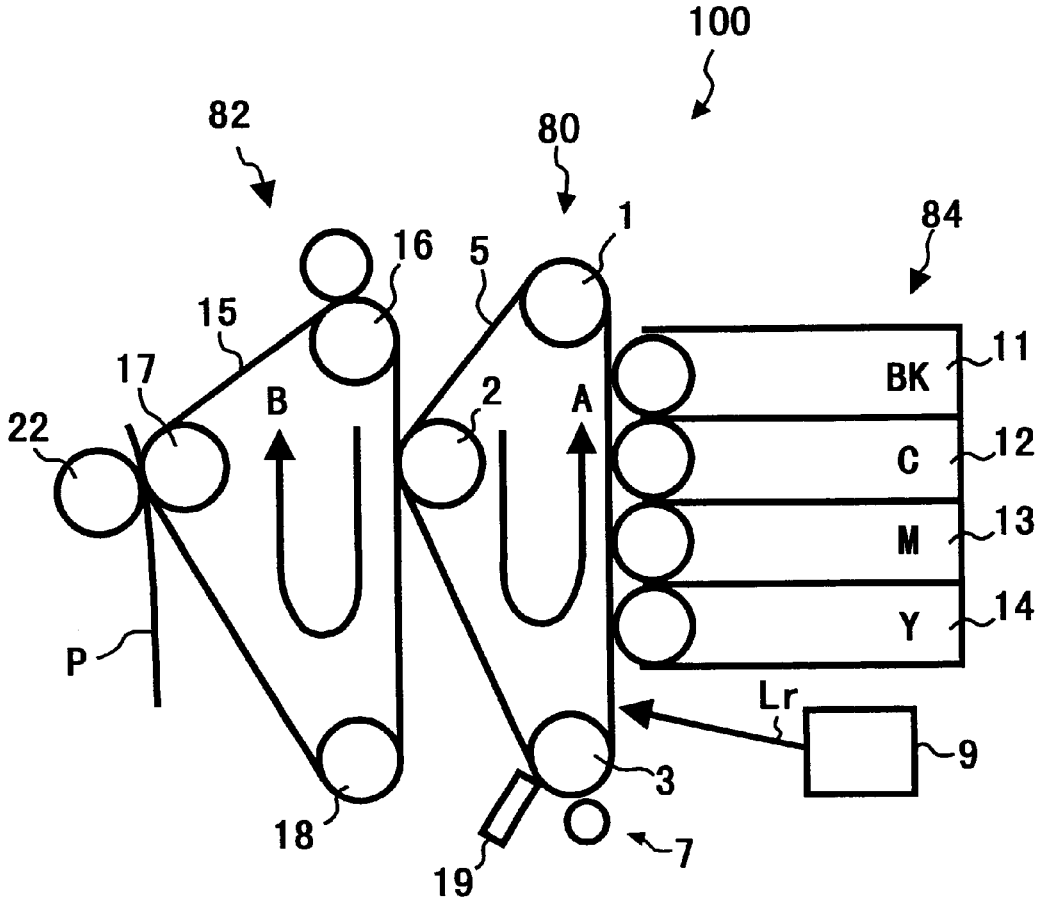
FIG. 1 is a schematic view illustrating an example of a color printer configured according to the present invention.

Referring now to the drawings, wherein like reference numerals designate identical or corresponding parts throughout the several views, and more particularly to FIG. 1 thereof, FIG. 1 is a schematic diagram of a color printer 100 configured according to the present invention, includng a photoconductive belt module 80, an image transfer module 82, a developing module 84, and a laser raster scanning module 9.

The photoconductive belt module 80 includes an endless photoconductive belt 5 spanned around a first photoconductive belt spanning roller 1, a second photoconductive belt spanning roller 2, a third photoconductive belt spanning roller 3, a non-contact proximity charging device 7 opposing the third photoconductive belt spanning roller 3, and a cleaning blade 19. In this example, the endless photoconductive belt 5 has a seam. However, the endless photoconductive belt 5 may also be a seamless endless belt.

Since the photoconductive belt module 80 is configured as a single unit, when the module 80 reaches the end of its lifespan or is damaged, the used module 80 can be detached from the color printer 100 and a new photoconductive belt module can be installed in a relatively easy operation.

The image transfer module 82 includes an intermediate transfer belt 15 spanned around transfer belt rollers 16, 17 and 18, a toner image transfer roller 22. The developing module 84 includes a black developing device 11, a cyan developing device 12, a magenta developing device 13, and a yellow developing device 14. During an image forming operation, each of the developing devices 11, 12, 13 and 14 is biased at a substantially constant voltage, for example, approximately −280 volts.

Figure 2:
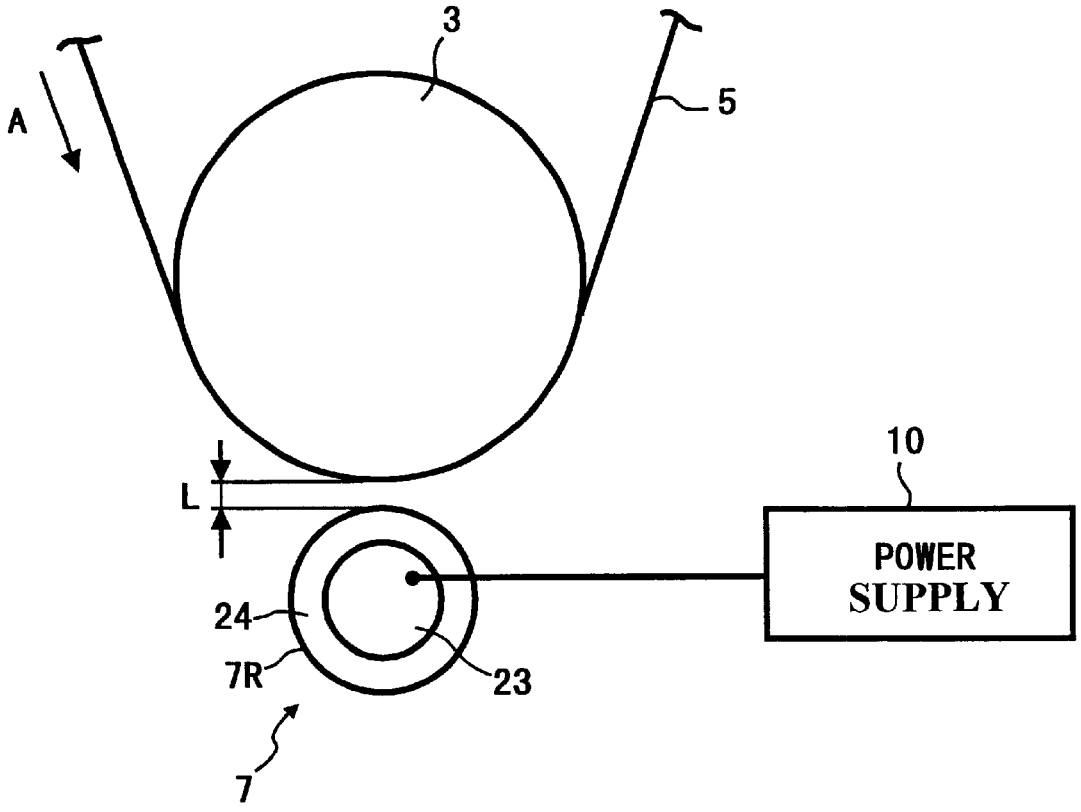
FIG. 2 is a magnified view of the non-contact proximity charging device and the circumference thereof of FIG. 1.

FIG. 2 is a magnified view of the non-contact proximity charging device 7 and the circumference thereof configured according to the present invention. Referring to FIG. 2, the non-contact proximity charging device 7 includes a charging roller 7R having an axis disposed opposing the third photoconductive belt spanning roller 3 and substantially parallel to the axis of the third photoconductives belt spanning roller 3. The surface of the charging roller 7R is disposed apart from the surface of the endless photoconductive belt 5 at a predetermined small distance L. As the predetermined small distance L, in this example, a distance 70±10 $\mu$m is used as a design dimension. However, the distance L is not limited in this dimension, for example, the distance L may also be approximately 3 $\mu$m to 300 $\mu$m.

As an example, a metal core 23 having approximately 6 millimeters in diameter and an outer layer 24 having approximately 14 millimeters in outer diameter on the metal core 23 compose the charging roller 7R. The outer layer 24 is desirable to have an appropriate electrical conductivity, such as a metal, a mixture of dielectric material and electrically conductive dispersant or the like. As an example, a dielectric material such as a synthetic resin or rubber and carbon powders dispersed in the dielectric material having approximately $10^9$ ohm-cm to $10^{12}$ ohm-cm in electrical resistance is one of preferable materials for the outer layer 24.

During an image forming operation, a power supply 10 supplies the metal core 23 with electric power to cause a gaseous discharge at the air gap formed between the outer layer 24 and the surface of the endless photoconductive belt 5. As a result of the discharge, the surface of the endless photoconductive belt 5 is electrically charged. In this example, the surface of endless photo conductive belt 5 is charged to a substantially uniform voltage, for example, approximately −580 volts.

An image forming operation is next described. Referring back to FIG. 1, when the color printer 100 receives print data accompanying a print command from an external apparatus, such as a personal computer, the endless photoconductive belt 5 is rotated in a direction as illustrated by the arrow A and the intermediate transfer belt 15 is rotated in a direction as illustrated by the arrow B by a motor. In this example, the endless photoconductive belt 5 is conveyed at a velocity of 133 millimeters per second. After starting of the rotation, a discharging lamp irradiates the surface of the endless photoconductive belt 5 with the light at location upstream from the non-contact proximity charging device 7 to discharge electrical charge on the photoconductive belt 5 remaining after the previous image forming operations.

Thereafter, when the endless photoconductive belt 5 passes through the air gap formed between the third photoconductive belt spanning roller 3 and the charging roller 7R, the charging roller 7R electrically charges the surface of the endless photoconductive belt 5 by a gaseous discharge current, the power for which is supplied by the power supply 10 of FIG. 2. Thus, the surface of the endless photoconductive belt 5 is electrically charged at a substantially uniform voltage such as approximately −580 volts.

The laser raster scanning module 9 then irradiates the charged endless photoconductive belt 5 with a raster scanning laser beam denoted as "Lr", according to first color data, for example, cyan data included in the received print data. Thus, an electrostatic latent image according to the first color data is formed on the endless photoconductive belt 5.

Then, one of the developing devices 11, 12, 13 and 14 of the developing module 84, which corresponds to the first color data, develops the formed electrostatic latent image. Accordingly, a first color toner image according to the first color data is formed on the endless photoconductive belt 5. The first color toner image is then conveyed to a position opposing the intermediate transfer belt 15. While the intermediate transfer belt 15 is conveyed at a substantially identical velocity to the circumferential velocity of the endless photoconductive belt 5, and intermediate transfer power source supplies the transfer belt rollers 16 and 18 with an appropriate image transfer voltage. Thereby, the first color toner image on the endless photoconductive belt 5 is attracted toward the intermediate transfer belt 15 and transferred to the intermediate transfer belt 15. The first color toner image is thus formed on the intermediate transfer belt 15.

Toner particles remaining on the surface of the endless photoconductive belt 5 are removed by the cleaning blade 19, and the endless photoconductive belt 5 is discharged by the discharging lamp again.

Thereafter, when the endless photoconductive belt 5 passes again through the air gap formed between the third photoconductive belt spanning roller 3 and the charging roller 7R, the charging roller 7R electrically charges again the surface of the endless photoconductive belt 5. Thus, the surface of the endless photoconductive belt 5 is charged at a substantially uniform voltage such as approximately −580 volts. The charging voltage may be changed according to the number of color images formed.

The charged endless photoconductive belt 5 is then exposed by the laser raster scanning module 9 with a raster scanning laser beam according to second color data, for example, magenta data included in the received print data. Thus, an electrostatic latent image according to the second color data is formed on the endless photoconductive belt 5.

Then one of the developing devices 11, 12, 13 and 14 corresponding to the second color develops the electrostatic latent image, and thus a second color toner image is formed on the endless photoconductive belt 5. The second color toner image is then conveyed to the position opposing the intermediate transfer belt 15.

The intermediate transfer belt 15 and the endless photoconductive belt 5 have substantially the same circumferential length, and are conveyed at substantially the same circumferential velocity. Accordingly, when the leading edge of the first color toner image on the intermediate transfer belt 15 arrives at the position opposite the second photoconductive belt spanning roller 2, the leading edge of the second color toner image on the endless photoconductive belt 5 also arrives at substantially the same position. The intermediate transfer power source supplies again the transfer belt rollers 16 and 18 with an appropriate image transfer voltage. Thereby, the second color toner image on the endless photoconductive belt 5 is attracted toward the intermediate transfer belt 15 and transferred upon the first color image on the intermediate transfer belt 15.

Similarly, a third color toner image is overlaid upon the second color toner image, and a fourth color toner image is overlaid upon the third color toner image on the intermediate transfer belt 15. Thus, a four color toner layer image is formed on the intermediate transfer belt 15.

Meanwhile, when the four color toner layer image has been formed on the intermediate transfer belt 15, a sheet of paper denoted by "P" is conveyed by a paper feed device to the position where the toner image transfer roller 22 opposes the intermediate transfer belt 15. While the sheet P is conveyed at a substantially identical velocity to the circumferential velocity of the intermediate transfer belt 15, a toner image transfer power source supplies the toner image transfer roller 22 with an appropriate image transfer voltage. By this means, the overlaid four color toner image on the intermediate transfer belt 15 is attracted toward the sheet P and transferred to the sheet P.

The sheet P having the transferred four color toner image is further conveyed to a fixing device where the toner image is fixed on the sheet P by heat and pressure. The sheet P is then discharged outside the color printer 100, and stacked on a print tray as a full color print.

As stated above, the charging roller 7R is disposed at a position opposite the third photoconductive belt spanning roller 3. At this position, the endless photoconductive belt 5 is spanned around the third photoconductive belt spanning roller 3 at an appropriate tension, so that the endless photoconductive belt 5 follows the surface of the third photoconductive belt spanning roller 3. As a result, the endless photoconductive belt 5 is resistant to flutter at the charging position, and consequently the predetermined small distance L, i.e., the air gap L, between the charging roller 7R and the surface of the endless photoconductive belt 5 is relative accurately maintained in a stable manner.

In addition, the endless photoconductive belt S is curled at the charging position, and the curled portion possesses high stiffness compared to a flat portion of the photoconductive belt 5. Consequently, fluttering of the photoconductive belt 5 is further suppressed.

The present inventor has carried out experiments on locations of the charging roller 7R. An image forming experiment has been carried out under a condition that the charging roller 7R is disposed between the second photoconductive belt spanning roller 2 and the third photoconductive belt spanning roller 3. The other image forming experiment has been carried out under a condition that the charging roller 7R is disposed opposing the third photoconductive belt spanning roller 3 as illustrated in FIG. 1 and FIG. 2.

According to the former experimental result, a relative large charge uneveness that causes defective images, such as a background soiling and a low image density, has been observed. Such large charge unevenness resulted from fluttering of the endless photoconductive belt 5, i.e., fluctuations in the distance between the endless photoconductive belt 5 and the charging roller 7R.

According to the latter experimental result, because of diminution of fluttering of the endless photoconductive belt 5 in the vicinity of the third photoconductive belt spanning roller 3, an improvement in charge unevenness has been observed, i.e., the above-described defective images were improved.

As stated above, as the endless photoconductive belt 5, both a seamed endless belt and a seamless endless photoconductive belt can be used in the color printer 100. When a seamless endless belt is used in the color printer 100, because of the substantially uniform thickness of the photoconductive belt, further special considerations to maintain air gap L may not be needed. However, when a seamed endless photoconductive belt is used, further consideration may achieve a better result.

Figure 3:
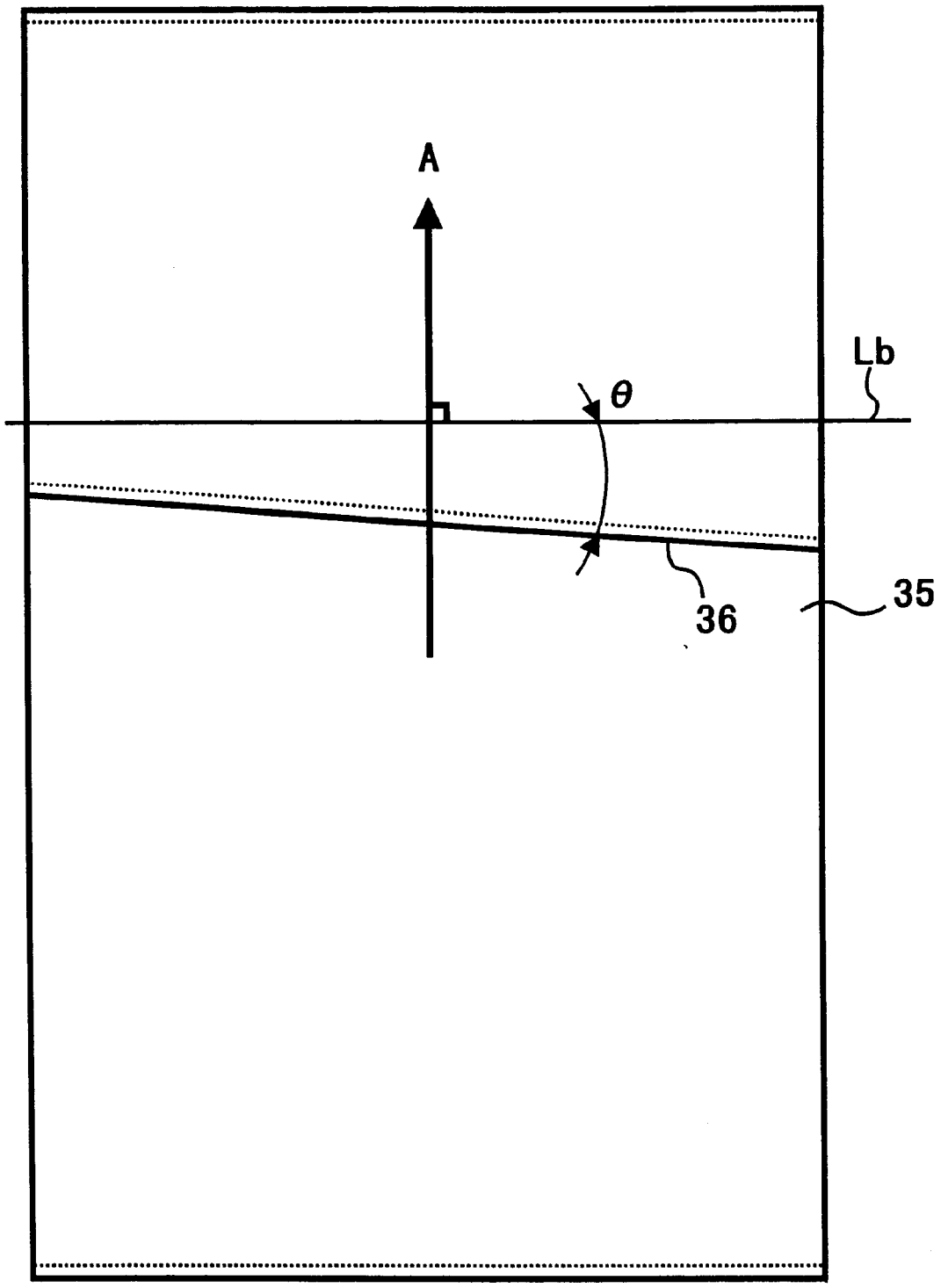
FIG. 3 is a diagram illustrating a seamed endless photoconductive belt.

FIG. 3 is a diagram illustrating a seamed endless photoconductive belt 35 as an example. With reference to FIG. 3, the arrow A indicates a direction to be conveyed during an image forming operation in the color printer 100, and Lb denotes a line perpendicular to the arrow A. The seamed endless photoconductive belt 35 has a seam 36 at an angle of θ to the line Lb. In this example, the seam 36 tilts two degrees as the angle θ to the line Lb. The tilting angle is not limited to this angle, but may also be other angles including zero degrees, i.e., no tilting angle.

The thickness of the photoconductive belt 35 at the seam 36 is approximately the thickness of the other portion because an end of a photoconductive sheet material is lapped over the other end at the seam 36. In other words, a difference in level, which corresponds to the thickness of the photoconductive sheet material, is formed at the seam 36. In this example, the difference in level is about 0.1 millimeters.

The charging roller 7R of the non-contact proximity charging device 7 may contact the seamed endless photoconductive belt 35 at the seam 36 because of the approximately twice thickness. According to an experiment, when the non-contact proximity charging device 7 contacted the seamed endless photoconductive belt 35 at the seam 36, a thready color registration error or a band shaped partial registration error among the cyan, magenta, yellow and black toner images on a print was observed.

However, as stated above, the seam 36 is formed with the tilting angle θ, and therefore an impact force caused on the contact of the charging roller 7R with the photoconductive belt 35 is mitigated. Therefore, the above described thready registration error is decreased.

Figure 4:
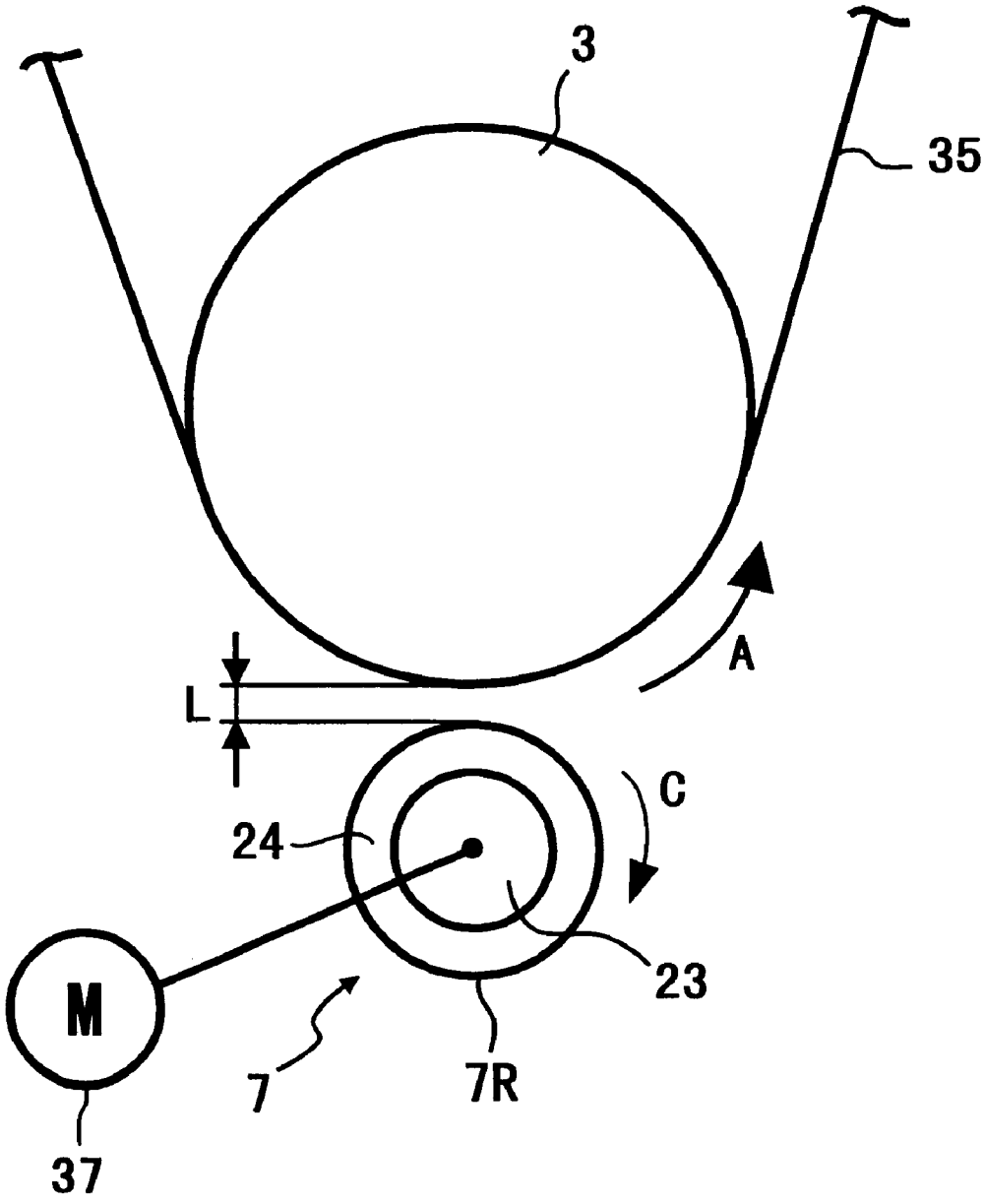
FIG. 4 is a schematic view illustrating a non-contact proximity charging device being rotated by a motor according to another example of the present invention.

FIG. 4 is a schematic view illustrating the non-contact proximity charging device 7 being rotated by a motor 37 as another example configured according to the present invention. In this example, the seamed endless photoconductive belt 35 of FIG. 3 is spanned around the third photoconductive belt spanning roller 3 and the other belt spanning rollers.

Because the motor 37 rotates the charging roller 7R in the same direction as the photoconductive belt 35 as illustrated by the arrow C, the impact force caused on the contact of the charging roller 7R with the seam 36 of the seamed photoconductive belt 35 is decreased. The circumferential velocity of the charging roller 7R is preferably equal or greater than that of the seamed endless photoconductive belt 35. For example, when the seamed endless photoconductive belt 35 is conveyed at a velocity of 133 millimeters per seconds, the circumferential velocity of the charging roller 7R is preferably rotated at a circumferential velocity of 133 millimeters per seconds or greater, such as 142 millimeters per seconds.

Referring back to FIG. 3, the seam 36 may be coated with an electrically nonconductive or insulating layer for preventing a short circuit of the charging circuitry when the charging roller 7R contacts the seamed endless photoconductive belt 35 at the seam 36. As an insulating layer, for example, polyamide polymers may be utilized.

The present inventor has carried out experiments on a coated insulating layer to the seam 36 of the seamed endless photoconductive belt 35, i.e., charging experiments on a seamed endless photoconductive belt 35 with and without a coated insulating layer on the seam 36.

Figure 5:
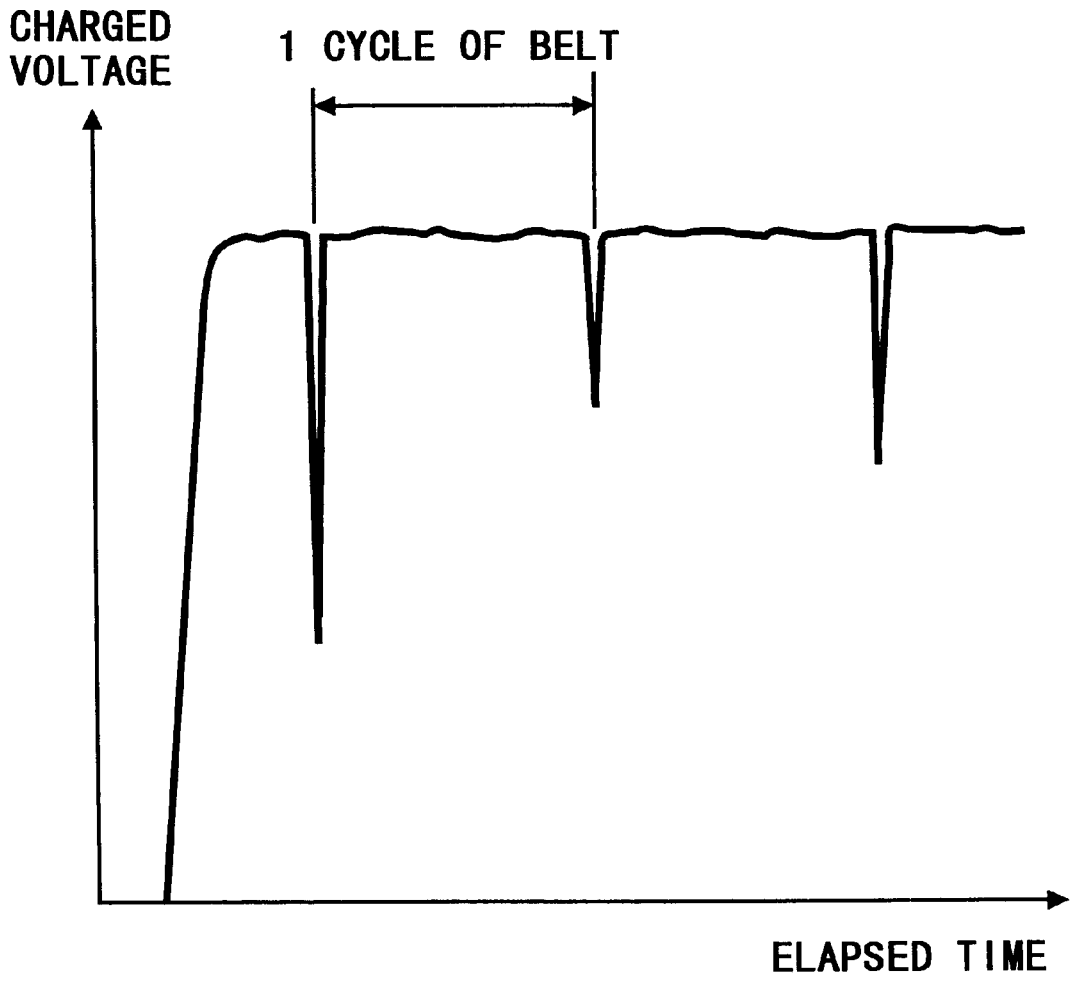
FIG. 5 is a graph illustrating a relationship between an elapsed time and a charged voltage on a photoconductive belt without provision of an insulating layer on the seam of the photoconductive belt.

FIG. 5 is a graph illustrating a relationship between an elapsed time and a charged voltage on the seamed endless photoconductive belt 35 without insulating layers on the seam of the photoconductive belt 35. Referring to FIG. 5, the waveform represents a charged voltage on the surface of the seamed endless photoconductive belt 35. As illustrated, notches i.e., low voltage portions in the waveform have been observed at elapsed times corresponding to contacts of the charging roller 7R with the seamed endless photoconductive belt 35 at the seam 36. Those low voltage portions were caused by short circuits of the charging circuitry configured by the charging roller 7R, a charging power supply like the power supply 10 of FIG. 2, the seamed endless photoconductive belt 35 or the like at the seam 36. When the short circuits of the charging circuitry occurred, band shaped or thready defective images, such as color reproduction defects, on a printed image were observed. Such short circuits also generates electrical noise, which sometimes causes a malfunction of a control circuit of the color printer 100. The short circuit may also cause damage to the charging roller 7R and the photoconductive belt 35.

Figure 6:
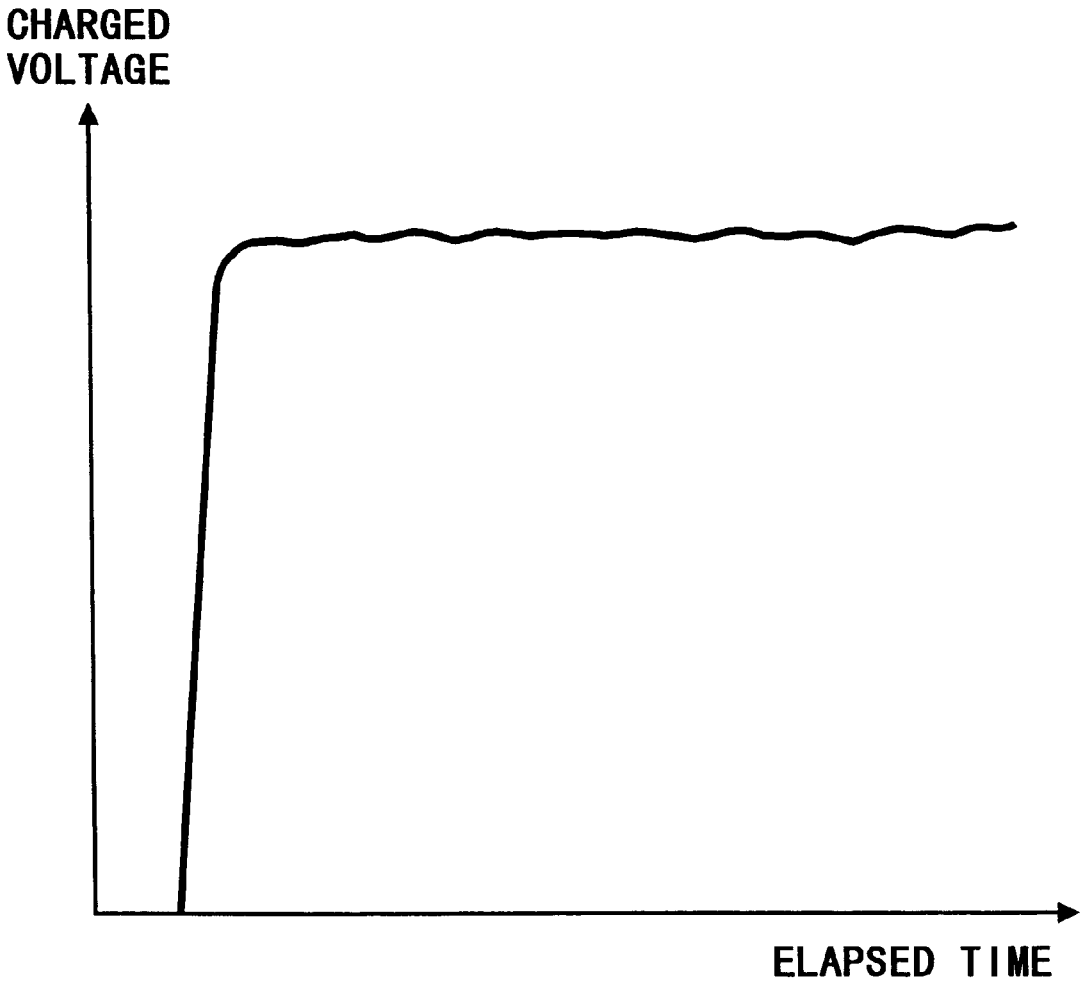
FIG. 6 is a graph illustrating a relationship between an elapsed time and a charged voltage on the photoconductive belt provided with an insulating layer on the seam of the photoconductive belt.

FIG. 6 is a graph illustrating a relationship between an elapsed time and a charged voltage on the photoconductive belt 35 with an insulating layer on the seam 36 of the photoconductive belt 35. As illustrated, the waveform of the charged voltage on the surface of the seamed endless photoconductive belt 35 does not include the notches as shown in FIG. 5. That is short circuits of the charging circuitry were prevented or decreased by the insulating layer on the seam 36.

Thus, the above-described defective images, such as a color reproduction error, are decreased. Further, a malfunction of a control circuit of the color printer 100 and damages to the charging roller 7R and the photoconductive belt 35 are also decreased.

Figure 7:
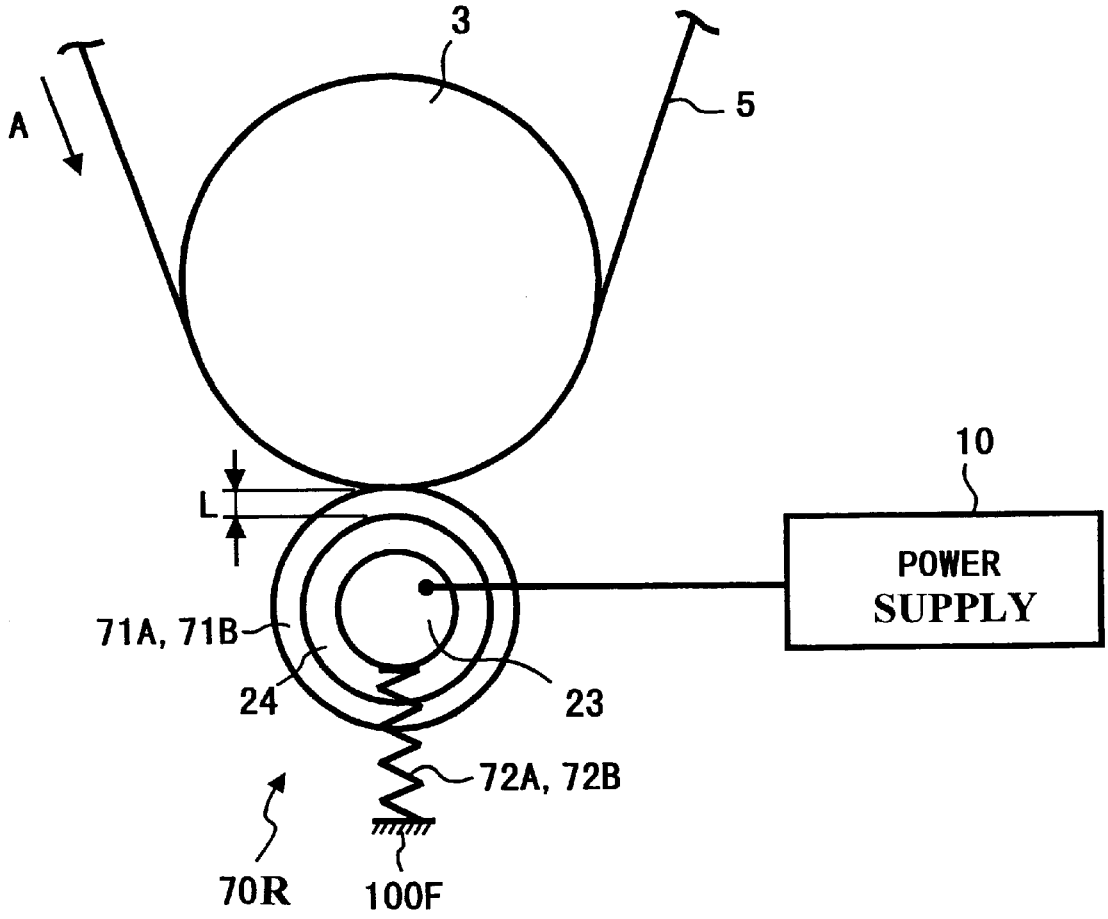
FIG. 7 is a schematic view illustrating a non-contact proximity charging device and the circumference thereof configured according to another example of the present invention.

FIG. 7 is a schematic view illustrating-a non-contact proximity charging device 70 and the circumference thereof configured according to another example of the present invention. In this example, the non-contact proximity charging device 70 includes a charging roller 70R and compression springs 72A and 72B.

Figure 8:
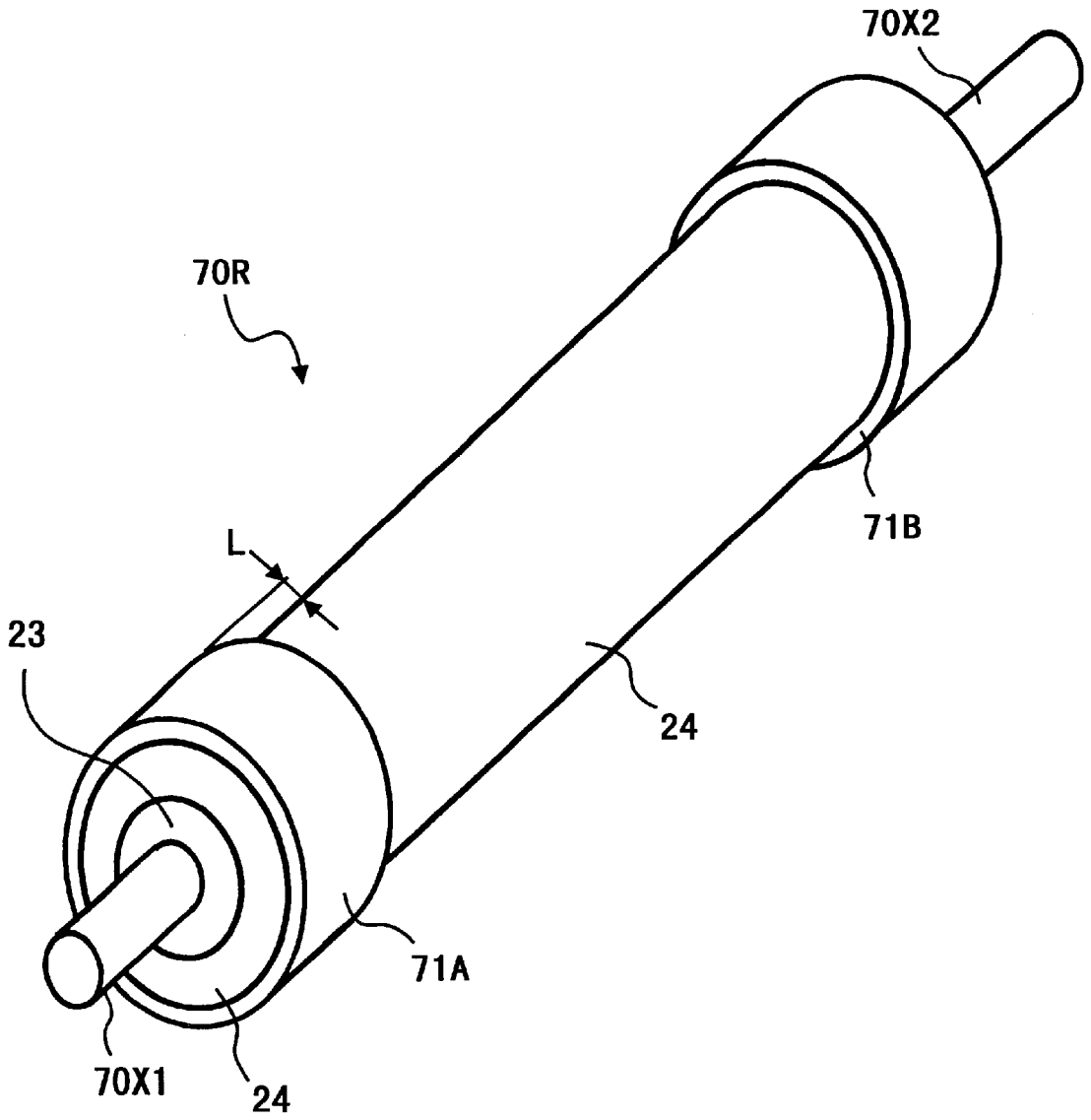
FIG. 8 is a perspective view illustrating a charging roller of FIG. 7 configured according to an example of the present invention.

FIG. 8 is a perspective view illustrating a charging roller 70R of FIG. 7 as an example configured according to the present invention. Referring to FIG. 8, the charging roller 70R includes a metal core 23, an outer layer 24, shafts 70X1 and 70X2, and spacing collars 71A and 71B. The spacing collars 71A and 71B are made of electrically nonconductive material, such as polyethylene resin, tetrafluoroethylene resin or the like and mounted on the outer layer 24. The thickness L of the spacing collars 71A and 71B in a radial direction are approximately 70±10 μm, as an example. The thickness L of the spacing collars 71A and 71B may also be approximately 3 μm to 300 μm.

Referring back to FIG. 7, the charging roller 70R is disposed opposite the third photoconductive belt spanning roller 3. The compression springs 72A and 72B are disposed between the shafts 70X1 and 70X2 of the charging roller 70R and an insulated frame 100F of the color printer 100. Accordingly, the compression springs 72A and 72B press the charging roller 70R such that the spacing collars 71A and 71B of the charging roller 70R sandwiches the photoconductive belt 5 with the third photoconductive belt spanning roller 3. Thus, the outer layer 24 of the charging roller 70R is spaced apart from the surface of the endless photoconductive belt 5 by the thickness L of the spacing collars 71A and 71B. During an image forming operation, the charging roller 70 follows the surface of the endless photoconductive belt 5 while maintaining an air gap L between the outer layer 24 and the endless photoconductive belt 5, which is equivalent to the thickness L of the spacing collars 71A and 711B, even at a seam of the photoconductive belt 5.

The following of the surface of the endless photoconductive belt 5 by the charging roller 70R achieves good air gap maintainability between the endless photoconductive belt 5 and the charging roller 70R. For example, even if the third photoconductive belt spanning roller 3 has an eccentric shaft or a distorted outer circle too some degree, the air gap L is automatically maintained in a relatively accurate dimension. In addition, a short circuit of the charging circuitry is prevented or decreased even when the seam of the endless photoconductive belt 5 is not coated with an insulating layer.

Figure 9:
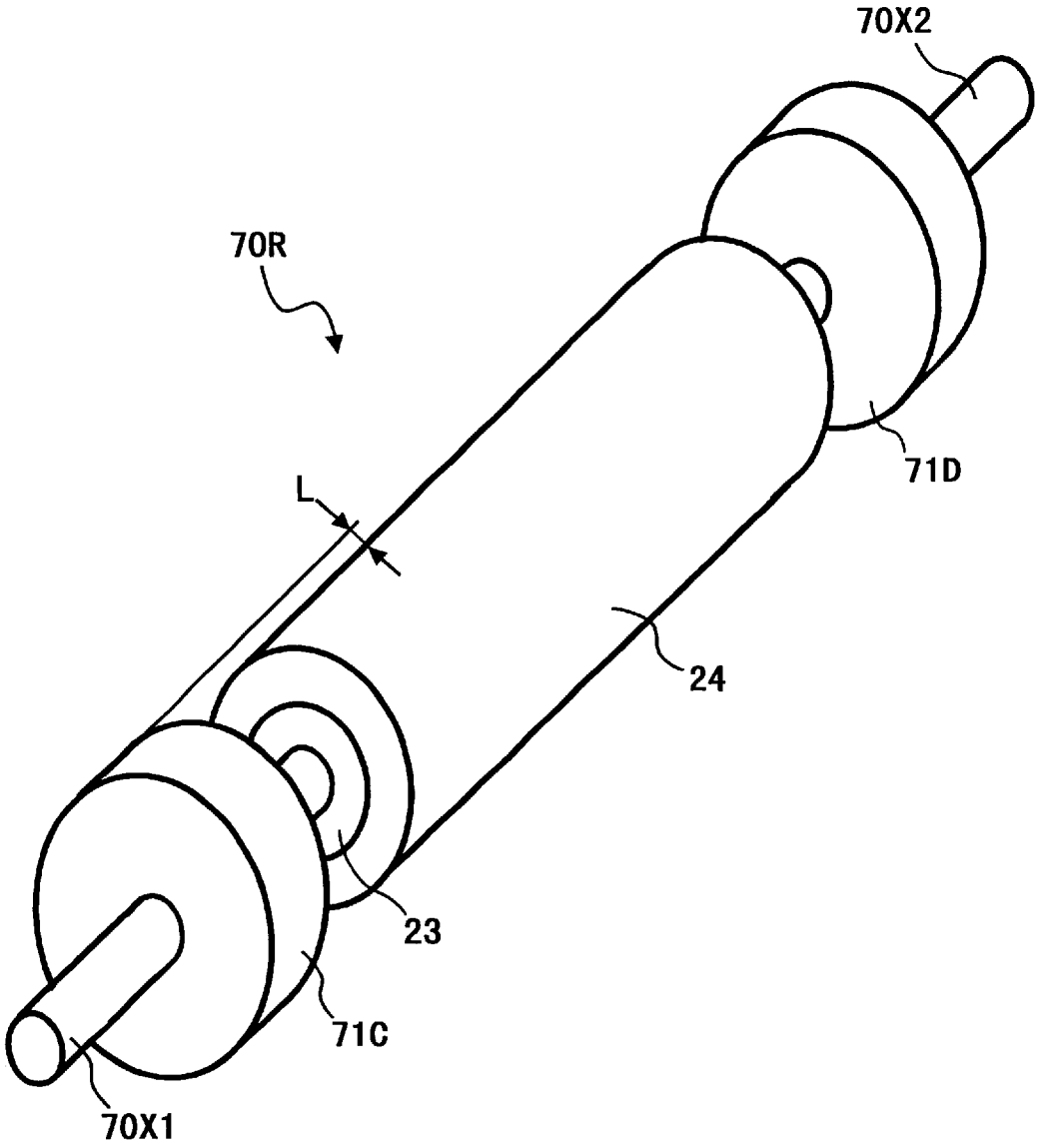
FIG. 9 is a perspective view illustrating the charging roller of FIG. 7 configured according to another example of the present invention.

FIG. 9 is a perspective view illustrating the charging roller 70R or FIG. 7 as another example configured according to the present invention. In this example, the charging roller 70R is provided with bushings 71C and 71D on the shafts 70X1 and 70X2 instead of the spacing collars 71A and 71B of FIG. 8. The radii of the bushings 71C and 71D are larger than the radius of the outer layer 24 of the charging roller 70R by an amount L that corresponds to the air gap between the charging roller 70R and the photoconductive belt 5. The bushings 71C and 71D may be made of an insulating material, such as polyacetal resin, polyamide resin, polycarbonate resin or the like.

In this example, the charging roller 70R also follows the surface of the endless photoconductive belt 5 while maintaining the air gap L between the outer layer 24 and the endless photoconductive belt 5 even at the seam of the photoconductive belt 5. Therefore, a gaseous discharge current in an image forming operation is produced in a stable manner. A short circuit of the charging circuitry is decreased even when a seamed endless photoconductive belt without an insulated seam is used.

As described above, the novel image forming apparatus and photoconductive belt module can improve charge unevenness of an endless photoconductive belt in a stable manner. The novel image forming apparatus and photoconductive belt module can also decrease occurrences of short circuits of a charging circuitry.

Obviously, numerous modifications and variations of the present invention are possible in light of the above teachings. For example, features described for certain embodiments may be combined with other embodiments described herein. It is therefore to be understood that within the scope of the appended claims, the invention may be practiced otherwise than as specifically described herein.

What is claimed as new and is desired to be secured by Letters Patent of the United States:

1. An image forming apparatus comprising:

an endless belt configured to be electrically charged, wherein the endless belt is a seamed endless belt;

a plurality of rollers configured to span the endless belt around the rollers and rotatively transport the endless belt;

a charging device disposed opposite and apart from one of the plurality of rollers at a predetermined distance from a surface of the endless belt and configured to charge the surface of the endless belt electrically, wherein the charging device has a roller shape; and a driving device configured to rotate the charging device such that a direction of a circumferential velocity of the charging device is the same as a direction of a circumferential velocity of the endless belt at an air gap formed between the charging device and the endless belt;

wherein the circumferential velocity of the charging device is approximately equal to or greater than the circumferential velocity of the endless belt at the air gap formed between the charging device and the endless belt.

2. The apparatus according to claim 1, wherein the endless belt is a photoconductive member configured to convey an image thereupon.

3. The apparatus according to claim 1, wherein the charging device is disposed apart from the surface of the endless belt by 3 to 300 $\mu$m.

4. The apparatus according to claim 1, wherein the endless belt comprises an electrically non-conductive protection layer on the seam of the endless belt.

5. The apparatus according to claim 1, wherein the charging device comprises an outer layer having approximately $10^9$ ohm-cm to $10^{12}$ ohm-cm in electrical resistance.

6. The apparatus according to claim 1, wherein the charging device comprises a spacing member contacting the surface of the endless belt and configured to establish the predetermined distance between an outer surface of the charging device and the surface of the endless belt.

7. The apparatus according to claim 6, wherein the charging device comprises an outer layer having approximately $10^9$ ohm-cm to $10^{12}$ ohm-cm in electrical resistance.

8. A photoconductive belt module comprising:

an endless photoconductive belt configured to convey an image, wherein the endless photoconductive belt is a seamed endless belt;

a plurality of rollers configured to span the endless photoconductive belt around the rollers and rotatively transport the endless photoconductive belt;

a charging device disposed opposite one of the plurality of rollers and apart from a surface of the endless photoconductive belt by a predetermined distance and configured to charge the surface of the endless photoconductive belt electrically, wherein the charging device has a roller shape; and a driving device configured to rotate the charging device such that a direction of a circumferential velocity of the charging device is in the same direction as a direction of circumferential velocity of the endless photoconductive belt at an air gap formed between the charging device and the endless photoconductive belt;

wherein the circumferential velocity of the charging device is equal to or greater than the circumferential velocity of the endless photoconductive belt at the air gap formed between the charging device and the endless photoconductive belt.

9. The module according to claim 8, wherein the charging device is disposed apart from the surface of the endless photoconductive belt by approximately 70 micrometers.

10. The module according to claim 8, wherein the endless photoconductive belt comprises an electrically non-conductive protection layer on the seam of the endless photoconductive belt.

11. The module according to claim 8, wherein the charging device comprises an outer layer having approximately $10^9$ ohm-cm to $10^{12}$ ohm-cm in electrical resistance.

12. The module according to claim 8, wherein the seam of the endless photoconductive belt is tilted at an angle in relation to a line perpendicular to a direction in which the endless photoconductive belt is conveyed.

13. The module according to claim 12, wherein the tilting angle of the seam to the line perpendicular to the direction of the endless photoconductive belt is approximately two degrees.

14. The module according to claim 8, wherein the charging device comprises a spacing member contacting the surface of the endless photoconductive belt and configured to establish the predetermined distance between an outer surface of the charging device and the surface of the endless photoconductive belt.

15. The module according to claim 14, wherein the charging device comprises an outer layer having approximately $10^9$ ohm-cm to $10^{12}$ ohm-cm in electrical resistance.

16. An image forming apparatus comprising:

an endless belt configured to be electrically charged;

a plurality of rollers for spanning the endless belt around the rollers and rotatively transporting the endless belt;

charging means disposed opposite one of the plurality of rollers and apart from the surface of the endless belt at a predetermined distance for charging a surface of the endless belt electrically, wherein the charging means is roller shaped; and a driving device configured to rotate the charging means at a circumferential velocity which is equal to or greater than a circumferential velocity of the endless belt.

17. A photoconductive belt module comprising:

an endless photoconductive belt for conveying an image;

a plurality of rollers for spanning the endless photoconductive belt around the rollers and rotatively transporting the endless photoconductive belt;

charging means for electrically charging a surface of the endless photoconductive belt, the charging means being roller shaped and disposed opposing one of the plurality of rollers and apart from it a predetermined small distance from the surface of the endless photoconductive belt; and a driving device configured to rotate the charging means at a circumferential velocity equal to or greater than a circumferential velocity of the endless photoconductive belt.

* * * * *